US008973415B2

(12) United States Patent
Papaiz

(10) Patent No.: US 8,973,415 B2
(45) Date of Patent: Mar. 10, 2015

(54) PADLOCK STORAGE SYSTEM

(75) Inventor: Paolo Papaiz, San Paulo (BR)

(73) Assignee: Papaiz Nordeste Indústria e Comércio LTDA, Salvador (BR)

( * ) Notice: Subject to any disclaimer, the term of this patent is extended or adjusted under 35 U.S.C. 154(b) by 385 days.

(21) Appl. No.: 13/300,208

(22) Filed: Nov. 18, 2011

(65) Prior Publication Data

US 2012/0125058 A1 May 24, 2012

(30) Foreign Application Priority Data

Nov. 23, 2010 (BR) ..... 9002269 U

(51) Int. Cl.
*E05B 67/38* (2006.01)
*E05B 67/02* (2006.01)
*E05B 19/00* (2006.01)

(52) U.S. Cl.
CPC ..... *E05B 67/02* (2013.01); *E05B 19/0082* (2013.01); *E05B 2067/386* (2013.01)
USPC ..... 70/54; 70/50; 70/51; 70/52; 70/53; 70/55; 70/429; 70/430

(58) Field of Classification Search
USPC ..... 70/50–56, 429, 430, 456 R, DIG. 43, 70/DIG. 56
See application file for complete search history.

(56) References Cited

U.S. PATENT DOCUMENTS 962,087 A * 6/1910 Kuczynski ..... 70/38 R
1,662,612 A * 3/1928 Junkunc ..... 70/55
2,892,537 A * 6/1959 Schwartz
2,980,039 A * 4/1961 Jolly ..... 249/97
3,621,690 A * 11/1971 Whitcomb ..... 70/456 R
3,630,053 A * 12/1971 Krakauer ..... 70/51
3,680,337 A * 8/1972 Krakauer ..... 70/419
3,858,419 A * 1/1975 Hampton ..... 70/55
3,983,725 A * 10/1976 Manuel et al. ..... 70/55
4,317,344 A * 3/1982 Barnard ..... 70/55
5,440,909 A * 8/1995 Ely et al. ..... 70/395
5,487,291 A * 1/1996 Voigt ..... 70/456 R
D390,000 S * 2/1998 Savas ..... D3/208
6,129,029 A * 10/2000 Watson ..... 109/56
6,536,246 B2 * 3/2003 Wilson et al. ..... 70/233
7,171,830 B2 * 2/2007 Taljaard et al. ..... 70/50
7,225,649 B2 * 6/2007 Wyers ..... 70/34
2010/0126242 A1 * 5/2010 Perlmutter et al. ..... 70/456 R

* cited by examiner

*Primary Examiner* — Peter M Cuomo
*Assistant Examiner* — Ifeolu Adeboyejo
(74) *Attorney, Agent, or Firm* — Charles E. Bruzga; Jay S. Pattumudi; Bruzga & Associates

(57) ABSTRACT

In one example, a padlock storage system includes a central portion including a padlock body having a shackle and a key for opening the padlock body. The system includes an upper end having a chamber for accommodating the shackle and a lower end having a chamber for placement of a key. Additionally, a coupling system between the central portion and the lower end allows for rotation of the lower end in relation to the central portion and promotes the unlocking of the shackle, where the key activates the unlocking. The padlock system is operable in two operating positions, where the upper and lower ends are able to attach to each other by removal of the central portion or where the central portion is attached to both ends. When the central portion is removed, a retention capsule for containing the key is formed, and which can be held in an apparatus.

5 Claims, 10 Drawing Sheets

PADLOCK STORAGE SYSTEM

CROSS-REFERENCE TO RELATED APPLICATIONS

This application claims priority to Brazil Patent Application No. MU9002269-6, filed on Nov. 23, 2010, the disclosure of which is herein incorporated herein by reference.

FIELD OF THE INVENTION

This field relates to improvements in padlock storage systems.

BACKGROUND OF THE INVENTION

In the current prior art, several dispositions in locks are known.

Currently the locks assist users in many different applications in order to increase security in the sanctity of property.

The small locks allow for use in gyms lockers, schools, and other equipment for temporary confinement of small volumes. Since they are small, they are easy to transport, but they are difficult to keep. There are awkward situations for the use of "key ring" or other elements to store the key.

Normally, due to the small size of the small padlock's key, the user finds it difficult to locate the key, and may even lose the key when they do not want to store it on a "key ring". This represents a major drawback, because the loss of key results in the need to use a specialized service for its opening, or even its disruption and destruction.

In the state of the art, there are also locks that do not use a key to open, but these types of locks are not relevant for this disclosure.

There remains a continuous need for improved lock systems that avoid misplacing the key.

SUMMARY OF THE INVENTION

In one example, a padlock storage system includes a central portion including a padlock body having a shackle and a key for opening the padlock body. The system includes an upper end having an upper chamber for accommodating the shackle and a lower end having a lower chamber for placing and holding a key.

The central portion aims to protect and store the body of the padlock and includes a padlock body. The upper and lower ends are intended to protect the padlock rod and the key when the assembly is composed of three parts, i.e., the upper and lower ends over the central portion. Additionally, the padlock storage system includes a coupling system between the central portion and the lower end which allows for rotation of the lower end in relation to the central portion and promotes the unlocking of the shackle, where the key activates the unlocking.

The padlock system is operable in two operating positions, where the upper and lower ends are able to attach to each other by removal of the central portion or where central portion is attached to both the upper and lower ends. When the central portion and consequently, the padlock body is in use or out of the assembly, the upper and lower ends can form a key storage retention capsule for containing the padlock due to the existence of the bracelet or anklet as a link between the upper and lower ends, thereby allowing use of the capsule in the wrist and/or ankle, and thereby providing greater security in key storage. Thus, when the central portion is removed, a retention capsule for containing the key is formed and which can be held in an apparatus. The apparatus can be in the form of an anklet or a bracelet, for example.

In another example of the padlock storage system, such as smaller ones, a capsule or wrapping is formed when the padlock and (central portion) is in use or off the assembly and the extreme top and bottom parts are joined and engaged, involving and storing the key inside it, being connected by a bracelet or anklet, which makes it possible to transport the key fastened to the wrist and/or ankle.

DETAILED DESCRIPTION OF THE INVENTION

The examples and drawings provided in the detailed description are merely examples, which should not be used to limit the scope of the claims in any claim construction or interpretation.

In one example, a disposition introduced in the padlock, contains three parts of protection to the padlock and a bracelet or anklet for transportation, and two extreme mobile parts connected by bracelet or anklet and a central part, which includes a padlock body. The center part aims to protect and to store the body of the padlock. The outer edges are intended to protect the shaft and the key, when the assembly is composed of three parts (the extremes plus the central part).

When the padlock (central part) is in use or out of the assembly, the upper and lower ends can interlock, thereby forming a capsule for storage of the padlock key and, due to the existence of the bracelet or anklet acting as a link between the ends, it is possible to use the capsule on the wrist and/or ankle, thereby providing greater security in key storage.

Alternative constructive dispositions are disclosed, and the key can be attached to the far lower part of the disposition or the key can also be embedded and can be removed.

Figure 1:
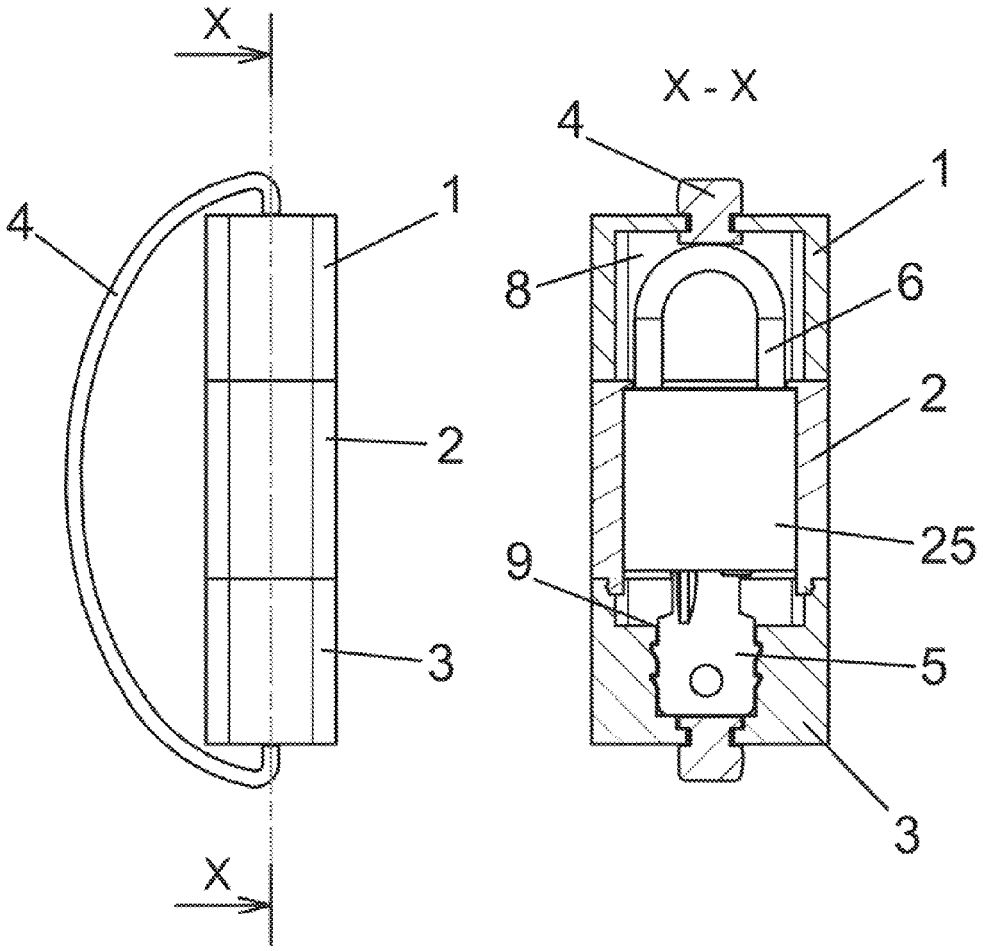
FIG. 1 is a left side view of the padlock of the present invention, with the three parts assembled plus the bracelet or anklet and one cutaway view taken at cut line X-X, showing the disposition of the padlock and key fastened to the model.

According to FIG. 1, a padlock disposition consists of an upper end (1) with a hollow interior chamber (8), and the said upper end (1) is attachable to the central part (2) which contains a padlock body (25) fixed inside the central part.

The central part (2) is attachable to both the upper end (1) and to the lower end (3), configuring an attachable set.

The chamber (8) of the upper end accommodates the padlock shackle (6) in its interior, with the said central part (2) coupled to the upper end (1). The padlock shackle may be a rod, for example.

The lower end (3) is provided with a chamber (9) that holds the key (5), which is fastened and is not removable from the lower end (3) in this embodiment.

Figure 2:
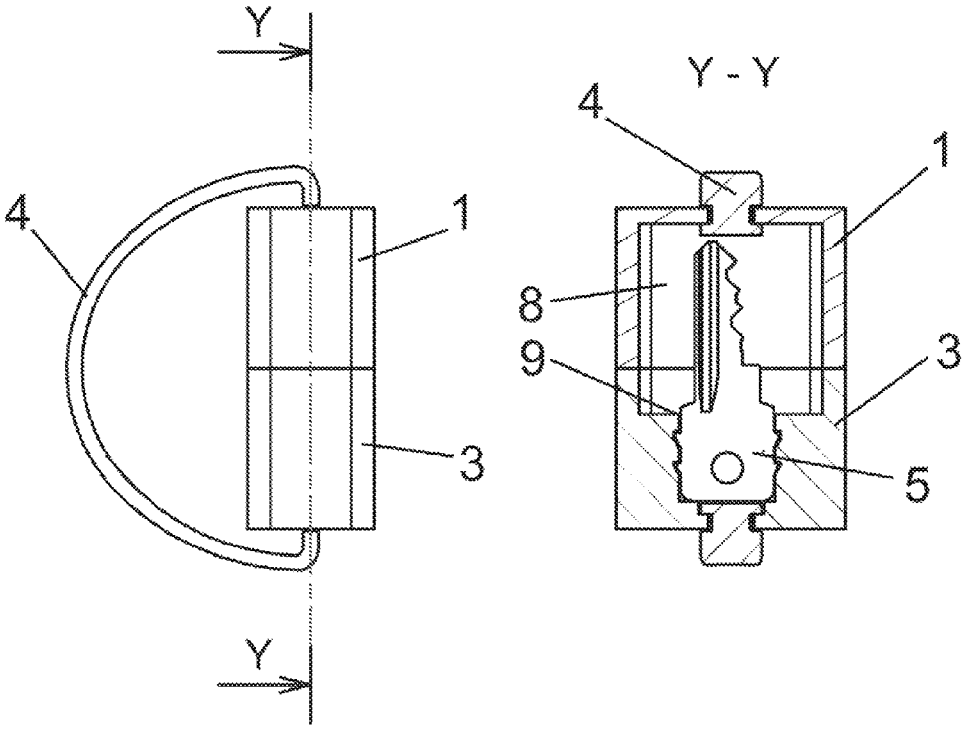
FIG. 2 is a left side view with the ends forming a "capsule" and a cutaway view, taken on the Y-Y cut line, revealing the disposition of the key fastened and integrant of the extreme lower part on the model.

As shown in FIG. 2, once the central part (2) is removed and consequently the padlock body (25) connected to it is removed, the upper end (1) and lower end (3) are attachable to each other, setting forth a retention capsule, thereby allowing for protection of the key (5) inside, and from the ends (1,3), an apparatus, which may be a bracelet or an anklet (4) or in combination forms, thereby joins the upper and lower ends (1,3), and is adjustable to the user's wrist and/or ankle, and is of various sizes. Thus, a bracelet or anklet (4) may be used to carry a retention capsule holding a key (5).

Thus, the use of the ends (1,3) attachable to the central part (2) allows the accommodation of the key (5) and padlock (6) inside the retention capsule.

Figure 3:
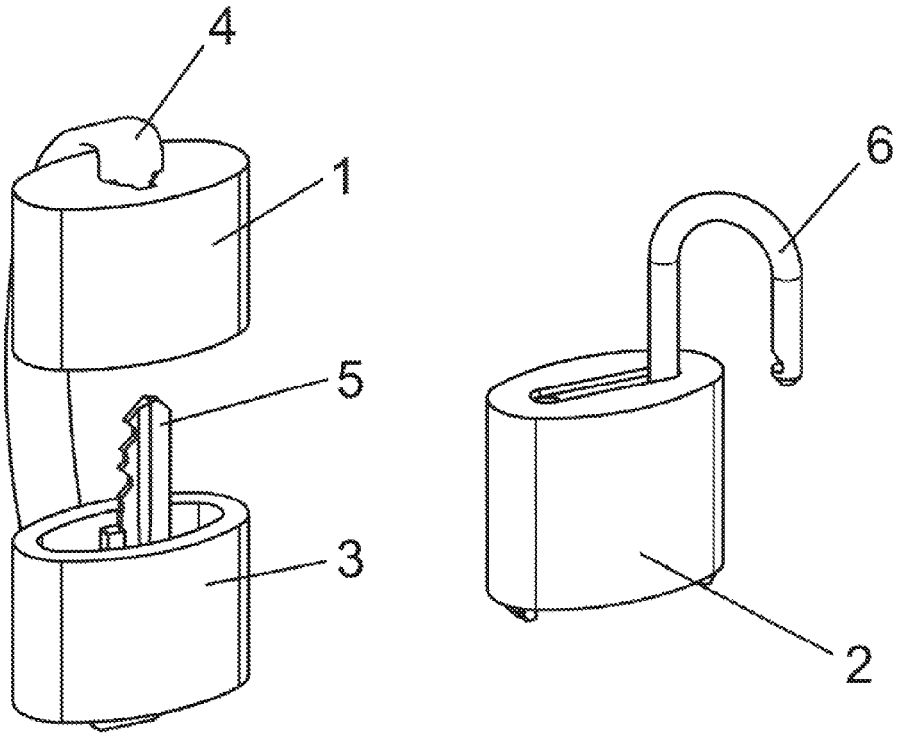
FIG. 3 is a perspective view with the central part (padlock plus fastened central part) outside of the assembly.

FIG. 3 is a perspective view with the central part (2) disengaged from the upper and lower ends (1,3).

Figure 4:
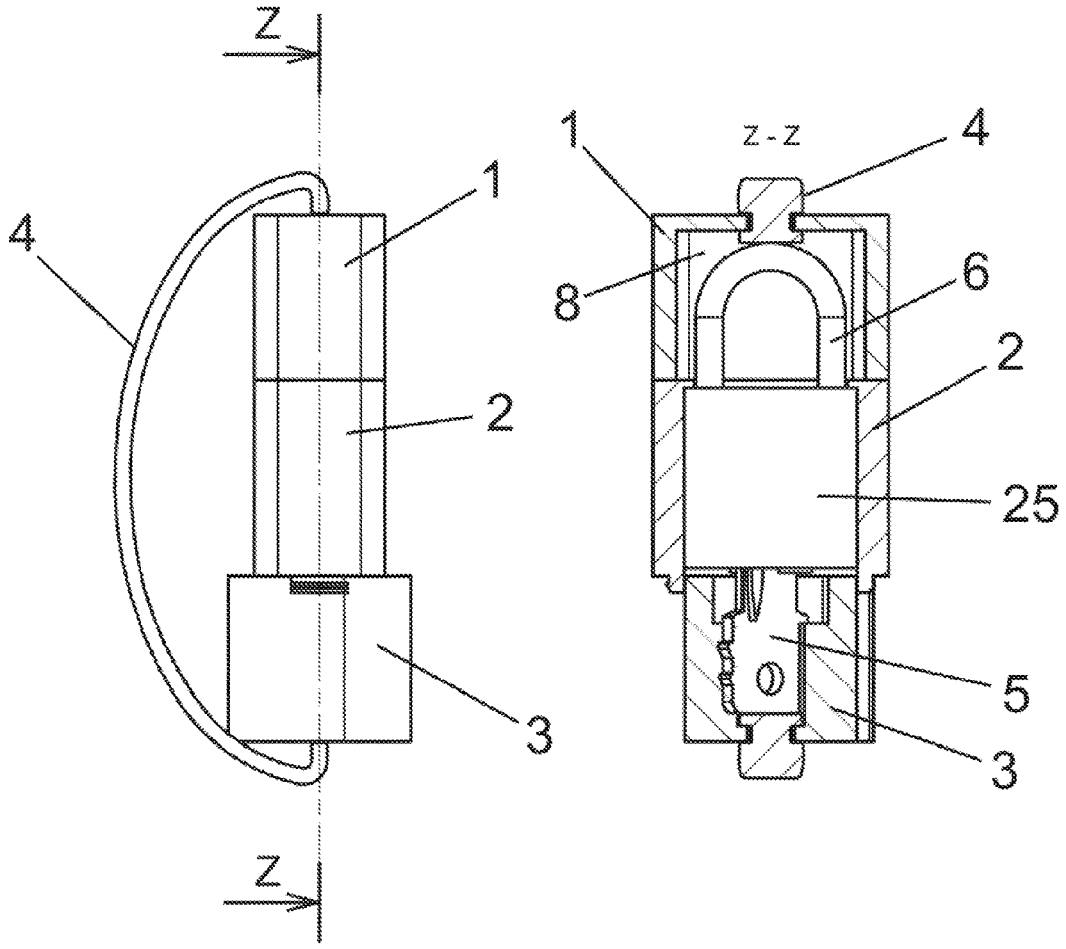
FIG. 4 is a left side view and a full cutaway view taken from the Z-Z cut line illustrating the rotation movement which unlocks the padlock.
Figure 5:
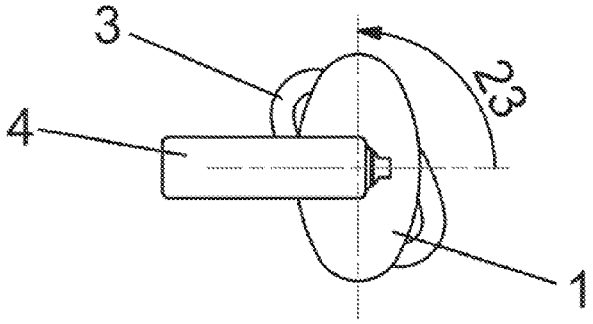
FIG. 5 is a top view illustrating the rotation movement to which unlocks the padlock, according to the disposition shown in FIG. 4.

As shown in FIGS. 4 and 5, the coupling system between the central part (2) and lower end (3) allows the rotation of the lower end (3) in relation to the central part (2), promoting the unlocking of the padlock shackle (6) from the padlock body 25, since key (5) activates its unlocking.

To use a free padlock, disengage the upper end (1) from the central part (2) and in turn, disengage the lower end (3) from the central part (2), such that the central part is thereby disengaged (2) and the padlock shackle (6) is thus unlocked from the padlock body (25). For example, the lower end (3) may be rotated or spinned (23) to be disengaged from the central part.

Figure 6:
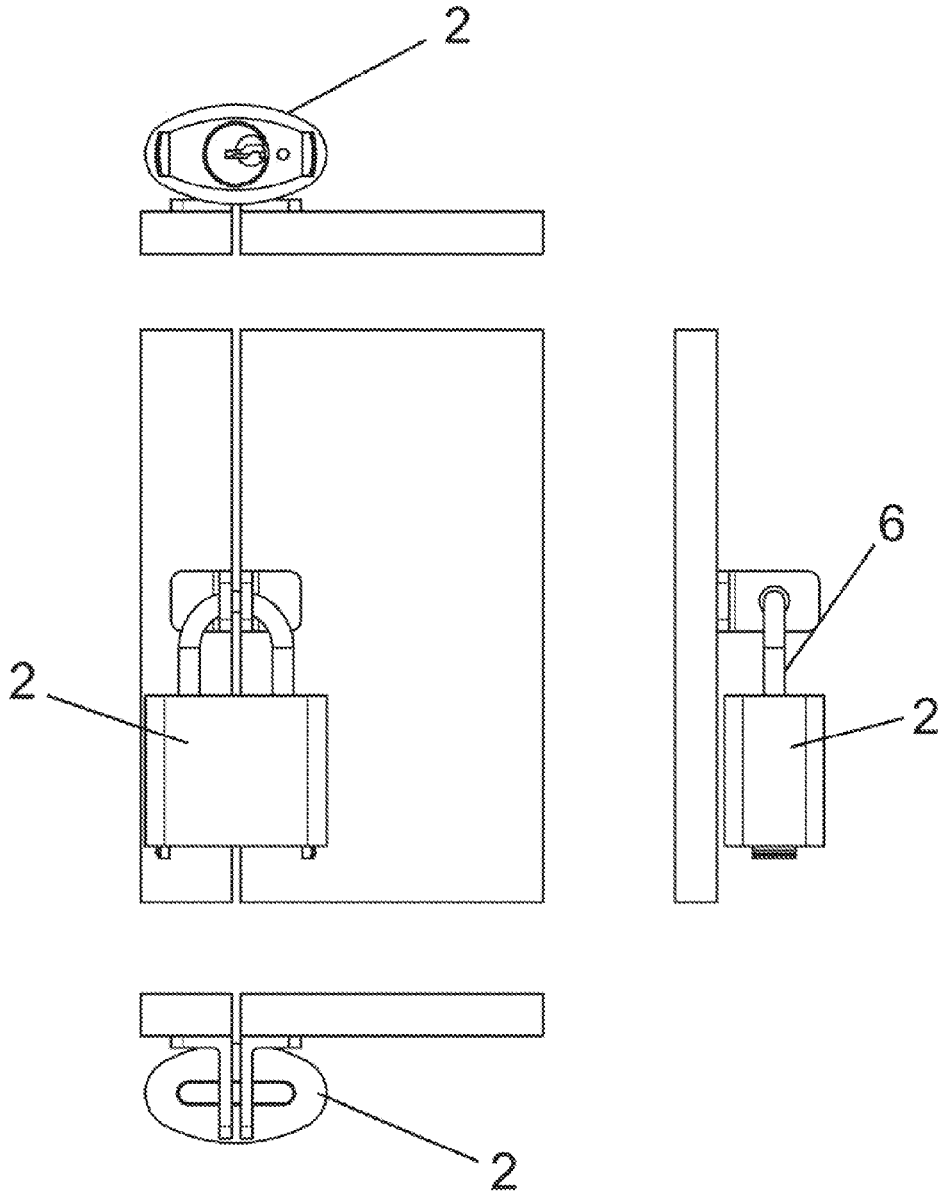
FIG. 6 is a view that illustrates the use of the central part (the padlock and fastened central part).

With the central part (2) disengaged and the padlock (6) unlocked from the padlock body (25), its use is allowable. FIG. 6 is a view that illustrates the use of the central part (2) and the padlock body (25) integrated to it.

Figure 7:
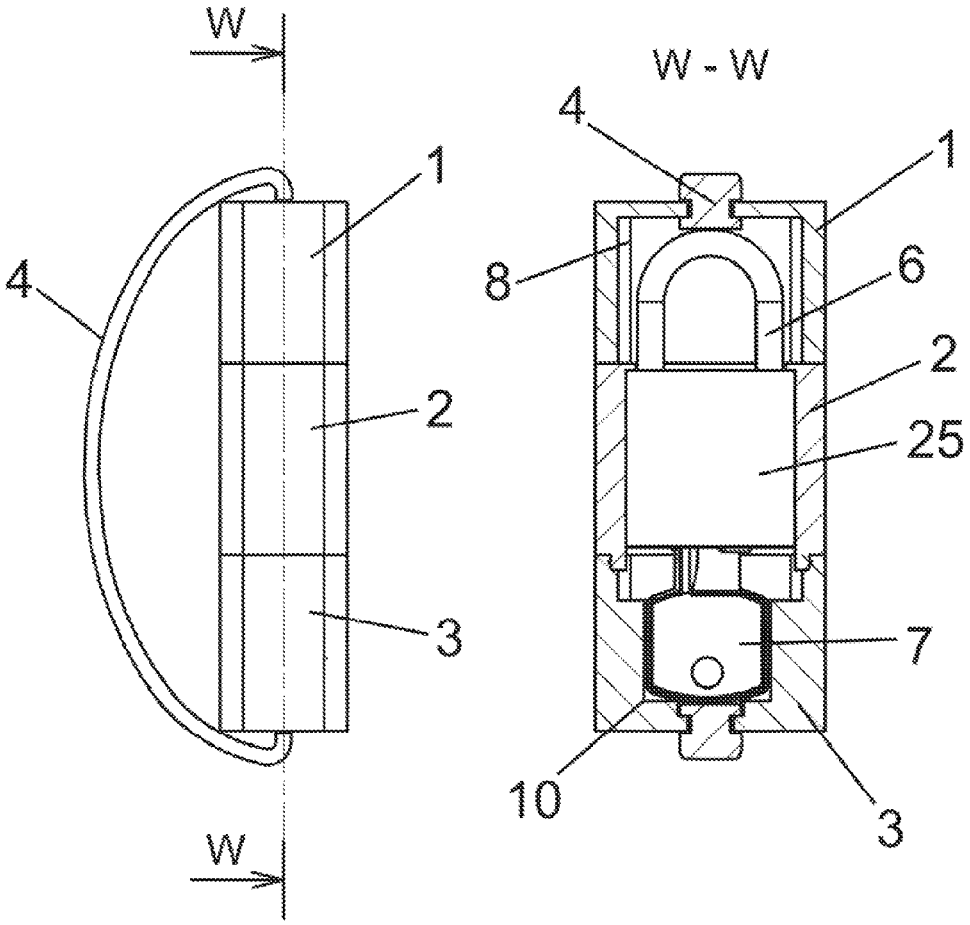
FIG. 7 is a left side view of a first alternative constructive disposition, with the three parts assembled plus the bracelet or anklet and a cutaway view taken from the W-W cut line, revealing the disposition of the padlock and not fastened key, being that it is attachable and removable from inside the lower edge part.
Figure 8:
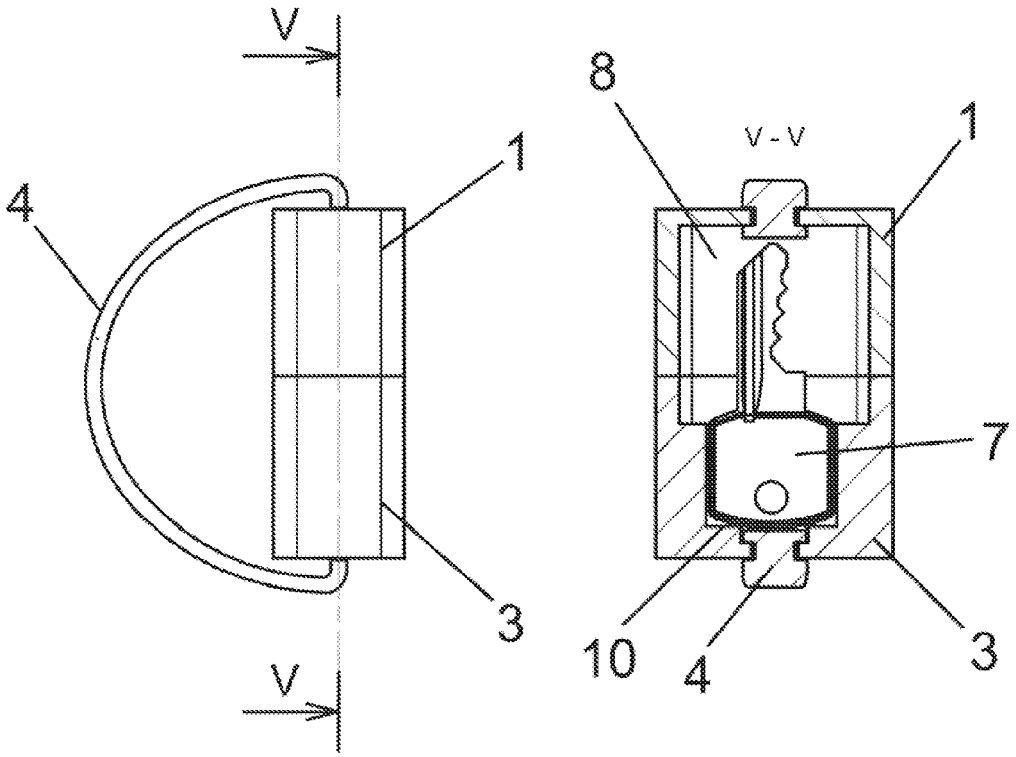
FIG. 8 is a left side view with the ends forming a "capsule" and a cutaway view taken at the V-V cut line, showing the disposition of the non-fastened key, as revealed in FIG. 7.
Figure 9:
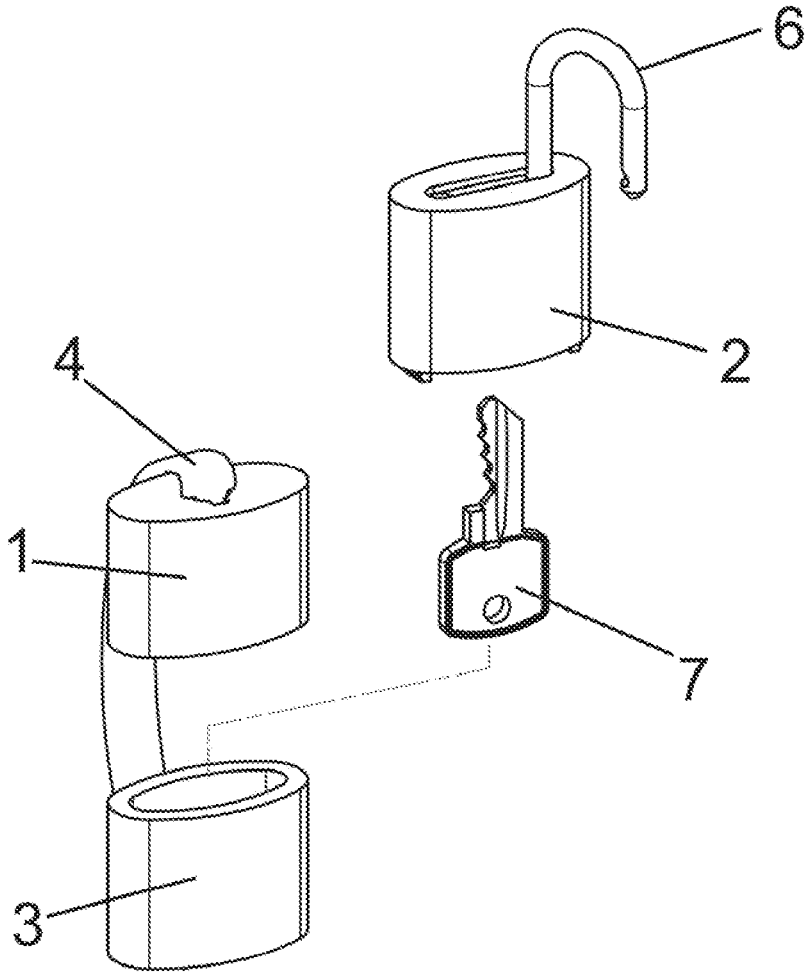
FIG. 9 is a perspective view with the central part (padlock plus fastened central part) outside the assembly and the key not fastened, revealed in FIGS. 7 and 8.

According to FIGS. 7 to 9, an alternative constructive disposition includes an upper end (1), with a hollow interior chamber (8), and the mentioned upper end (1) is attachable to the central part (2) which has the body of the padlock fastened inside.

The mentioned central part (2) is attachable both to the upper end (1) and the lower end (3), configuring an attachable set.

The chamber (8) of the upper end accommodates the padlock shackle (6) in its interior, and the mentioned central part 2 is coupled to the upper end (1).

The lower end (3) is provided with a chamber (10) that holds the key (7), which is attachable and removable from the lower end (3).

As shown in FIG. 8, once the central part (2) is removed and consequently the padlock body (25) connected to it, the upper end (1) and the lower end (3) are attachable to each other, configuring a retention capsule, thereby allowing for protection of key (7) inside, and from the upper and lower ends (1,3) comes out a bracelet or anklet (4) or combination forms, which joins the mentioned ends (1,3), and is adjustable to the user's wrist and/or ankle, and has various sizes.

Thus, the use of the ends (1,3) attachable to the central part (2) allows for the accommodation of the removable key (7) and padlock body (25) inside in the retention capsule.

FIG. 9 is a perspective view with the central part (2) and key (7) disengaged from the ends (1,3).

The coupling system between the central part (2) and lower end (3) allows the rotation of the mentioned lower end (3) in the central part (2), promoting the unlocking of the padlock shackle (6) from the padlock body (25), since the key (7) activates the padlock's unlocking, where the key is being housed inside the chamber (10) of the lower end.

To use a free padlock body (25), disengage the upper end (1) from the central part (2) and in turn disengage the lower end (3) from the central part (2) such that the central part (2) is disengaged and the padlock shackle (6) is unlocked from the padlock body (25), while allowing the non-fastened key (7), which does not remain lodged in the padlock body (25). Thus, when the central part (2) is disengaged and the padlock (6) is unlocked from the padlock body (25), it is possible to use the padlock.

For storage of the key (7), when not fastened to the retention capsule, the key is removed from the padlock body (25) and is installed in the chamber (10) of the lower end (3).

Figure 10:
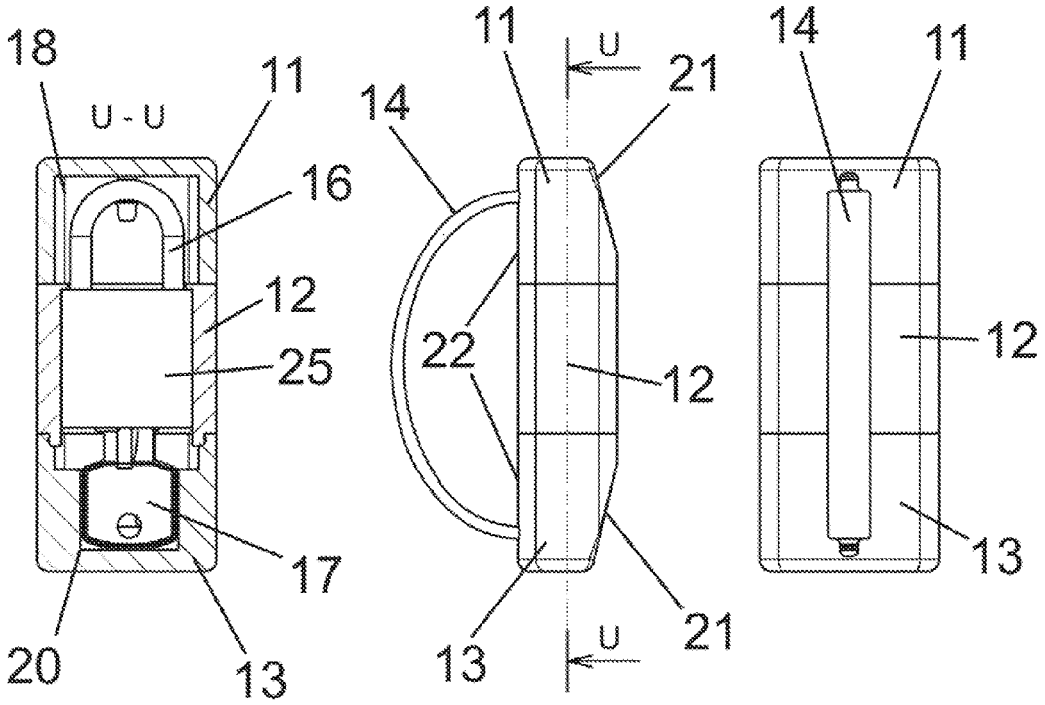
FIG. 10 is a cutaway view of a second constructive alternative, with the disposition of the padlock plus the key not fastened, a left side view taken from the U-U cut line with the three parts assembled and a rear view showing a new mounting location for the bracelet or anklet.
Figure 11:
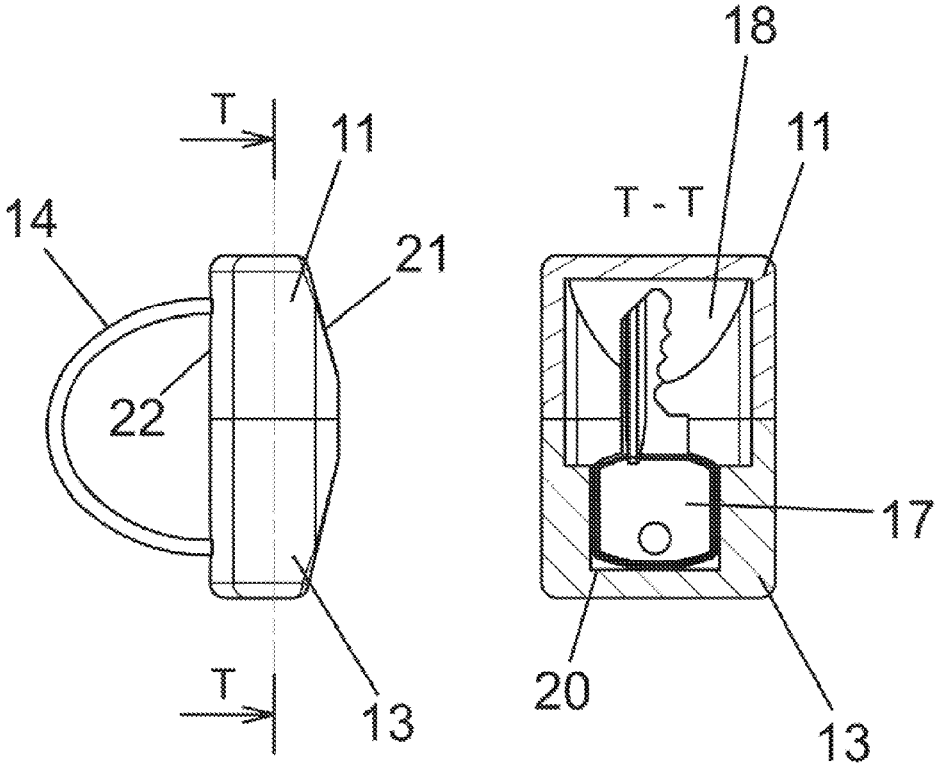
FIG. 11 is a left side view with the ends, revealed in FIG. 10, forming a "capsule" and a cutaway view taken along T-T revealing the disposition of the non-fastened key.

According to FIGS. 10 and 11, an alternative constructive disposition comprises an upper end (11), with a hollow interior chamber (18), and the mentioned upper end (11) is attachable to the central part (12) containing padlock body (25) fastened inside.

The mentioned central part (12) is attachable to both the upper end (11) and the lower end (13), configuring an attachable set.

The respective front part of the ends (11,13) are provided with ergonomic notches (21) which extend to the vicinity of a contact area with the central part (12).

The chamber (18) accommodates the padlock shackle (16) inside, with the mentioned central part (2) being coupled to the upper end (11).

The lower end (13) is provided with a chamber (20) that holds the key (17), which is attachable and removable from the lower end (13).

As shown in FIG. 11, once the central part (12), and consequently the padlock body (25) connected to it is removed, the upper end (11) and the lower end (13) are attachable to each other, configuring a retention capsule and protection of the key (17) inside, and from a respective rear face (22) of the ends (11,13), protrudes a bracelet or anklet (14) joining the mentioned ends (11,13), and which is adjustable to the user's wrist and/or ankle and has various sizes.

Thus, the use of ends (11,13) attachable to the central part (12) allows the accommodation of the removable key (17) and the padlock body (25) inside a retention capsule.

The coupling system between the central part (12) and lower end (13) allows for the rotation of the mentioned lower end (13) in the central part (12), promoting the unlocking of the padlock shackle (16) from the padlock body (25), since the key (17) activates the padlock's unlocking, where the key being housed inside the chamber (20).

To use the padlock body (25), disengage the upper end (11) from the central part (12) and in turn disengage the lower end (13) from the central part (12), such that the central part (12) is disengaged and the padlock shackle (16) is unlocked from the padlock body (25), while allowing the non-fastened key (17) to remain housed in the padlock body (25).

When the central part (12) is disengaged and the padlock body (25) is unlocked, the use of the padlock is possible.

To store the unfastened key (17) in the retention capsule, the key is removed from the padlock body (25) and the key is installed in the chamber (20) of the lower end (13).

One advantage of the disposition refers to the fact that the existence of the capsule allows for easy storage of the key, making it harder to lose.

Moreover, the existence of a bracelet or anklet allows the user to always have the key to the padlock with them during his or her activities, in a safe and practical manner.

Furthermore, the capsule represents a safe and ergonomic casing to keep the key inside.

The following is a list of reference numerals and associated parts as used in this specification and drawings:

| Reference Numeral | Part |
|---|---|
| 1 | Upper end |
| 2 | Central Part |
| 3 | Lower end |
| 4 | Anklet or Bracelet or Combination |
| 5 | Key |
| 6 | Padlock shackle |
| 7 | Key |
| 8 | Chamber |
| 9 | Cavity |
| 10 | Cavity |
| 11 | Upper end |
| 12 | Central Part |
| 13 | Lower end |
| 14 | Anklet or Bracelet or Combination |
| 16 | Padlock shackle |
| 17 | Key |
| 18 | Chamber |
| 20 | Cavity |
| 21 | Notches |
| 22 | Rear Face |
| 23 | Spin |
| 25 | Padlock body |

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A padlock storage system, comprising:

a) a central portion comprising:

i) a padlock body having a shackle; and ii) a key for opening the padlock body;

b) an upper end positioned from the central portion, the upper end having an upper chamber for accommodating the shackle;

c) a lower end, opposite to the upper end and positioned from the central portion; the lower end having an interiorly disposed lower chamber for placing and holding a key; and d) a coupling system between the central portion and the lower end, the coupling system allowing for rotation of the lower end in relation to the central portion, thereby promoting the unlocking of the shackle, and said key activating the unlocking;

e) the padlock storage system being operable in two operating positions, wherein in a first position, the central portion is configured to be attached to the upper and lower ends, and in a second position, the upper and lower ends are configured to attach to each other by removing the central portion;

wherein in the second position, a retention capsule for containing the key is formed and an apparatus for carrying the retention capsule joins the upper and lower ends.

2. The padlock storage system according to claim 1, wherein the key is removed from the lower chamber.

3. The padlock storage system according to claim 1, wherein each of the upper and lower ends includes external surfaces and each of the external surfaces includes chamfers.

4. The padlock storage system according to claim 1, wherein the accessory apparatus is in the form of a bracelet.

5. The padlock storage system according to claim 1, wherein the apparatus is in the form of an anklet.

* * * * *